US007036292B2

(12) United States Patent
Kutner

(10) Patent No.: US 7,036,292 B2
(45) Date of Patent: May 2, 2006

(54) METHOD FOR CONTAINING LIGHTWEIGHT MATERIALS

(75) Inventor: Kenneth Kutner, W. Hempstead, NY (US)

(73) Assignee: Container Packaging Corp, Paterson, NJ (US)

( * ) Notice: Subject to any disclaimer, the term of this patent is extended or adjusted under 35 U.S.C. 154(b) by 73 days.

(21) Appl. No.: 10/786,929

(22) Filed: Feb. 26, 2004

(65) Prior Publication Data

US 2004/0221550 A1 Nov. 11, 2004

Related U.S. Application Data

(60) Provisional application No. 60/464,748, filed on Apr. 24, 2003.

(51) Int. Cl.
*B65B 3/02* (2006.01)

(52) U.S. Cl. ..... 53/458; 53/468; 53/449

(58) Field of Classification Search ..... 53/410, 53/449, 457, 458, 468, 485
See application file for complete search history.

(56) References Cited

U.S. PATENT DOCUMENTS

| | | | | | |
|---|---|---|---|---|---|
| 3,459,357 | A | * | 8/1969 | Egger et al. | 229/117.32 |
| 3,774,509 | A | * | 11/1973 | Heinzer | 493/235 |
| 4,089,255 | A | * | 5/1978 | Akoh et al. | 493/76 |
| 4,142,453 | A | * | 3/1979 | Gidewall et al. | 493/100 |
| 4,287,703 | A | * | 9/1981 | Henle et al. | 53/449 |
| 4,413,464 | A | * | 11/1983 | Larsson et al. | 53/412 |
| 4,918,906 | A | * | 4/1990 | Ako | 53/449 |
| 5,090,614 | A | * | 2/1992 | Kupersmit | 229/117.04 |
| 5,157,900 | A | * | 10/1992 | Kupersmit | 53/449 |
| 5,443,102 | A | * | 8/1995 | Svendsen | 141/10 |

* cited by examiner

*Primary Examiner*—Stephen F. Gerrity
*Assistant Examiner*—Paul Durand
(74) *Attorney, Agent, or Firm*—Charles E. Temko

(57) ABSTRACT

A collapsible shipping container for lightweight materials, typically edible grain particles and flakes, including a box-like sealable container and a synthetic resinous lining element, all of which are disposable after a single usage. The containers are fully preassembled in collapsed condition for storage, and require only unfolding to erected condition prior to insertion of the liner, the filling of the liner with contents, the sealing of the liner, and the closing of the container with a lid or cover.

3 Claims, 2 Drawing Sheets

METHOD FOR CONTAINING LIGHTWEIGHT MATERIALS

RELATED APPLICATION

Reference is made to my now abandoned provisional application for letters patents Ser. No. 60/464,748, filed Apr. 24, 2003, to which a claim of priority is made.

BACKGROUND OF THE INVENTION

This invention relates generally to the field of collapsible containers, and more particularly to an improved method for bulk packaging of lightweight particulate material, typically edible grains and flakes for shipment to a packaging location where the same are packaged for individual sale.

In the prior art, containers used for this purpose have been manufactured in planar form, including a lid or cover to be assembled on sight for loading, a time consuming process, of a large number of units which must be assembled, including the lid, prior to loading to occupy a considerable amount of space within the loading plant until needed. Because of problems of sanitation, it is known to provide a separate liner, usually of synthetic resinous material, which is placed within the box prior to filling the liner which is subseqently sealed prior to closing the container. Because the loaded container normally weighs only several hundred pounds, the container may be made of relatively lightweight materials and is discarded after a single use.

It is known in the packaging art to provide collapsible reusable containers for use with relatively heavier-weight contents, the same being relatively expensive to manufacture, although offering the convenience of reusability.

SUMMARY OF THE INVENTION

Briefly stated, the invention contemplates the provision of an improved relatively lightweight collapsible container for one time usage which, in collapsed condition, occupies a relatively small storage space, but which is readily erected for filling using a sanitary inner liner and which is filled after positioning the liner within the erected container to be subsequently sealed after filling. The containers and liners are readily stored in stacked and/or spooled condition, in the case of the liners, for assembly at a filling station immediately prior to filling to permit rapid processing.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
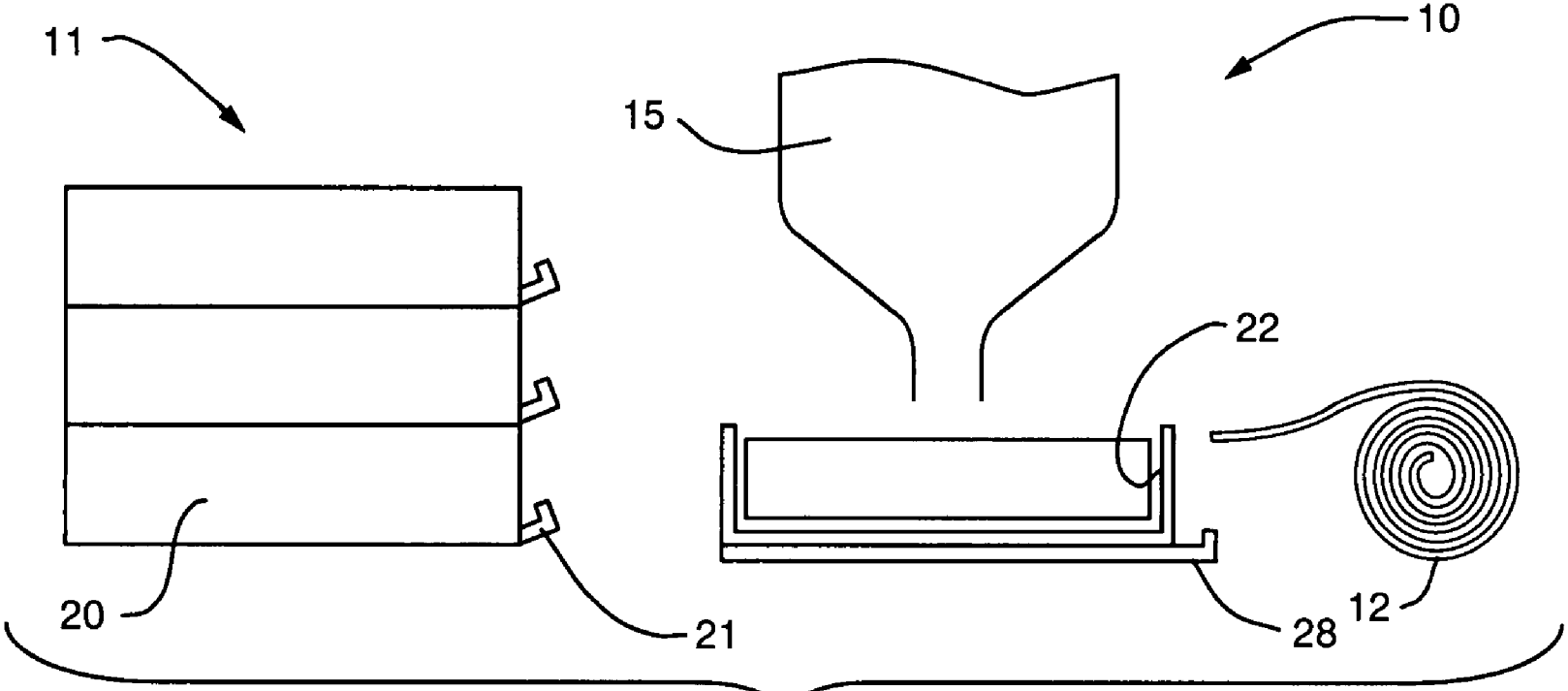
FIG. 1 is a schematic view showing an assembly and loading station embodying the invention.
Figure 2:
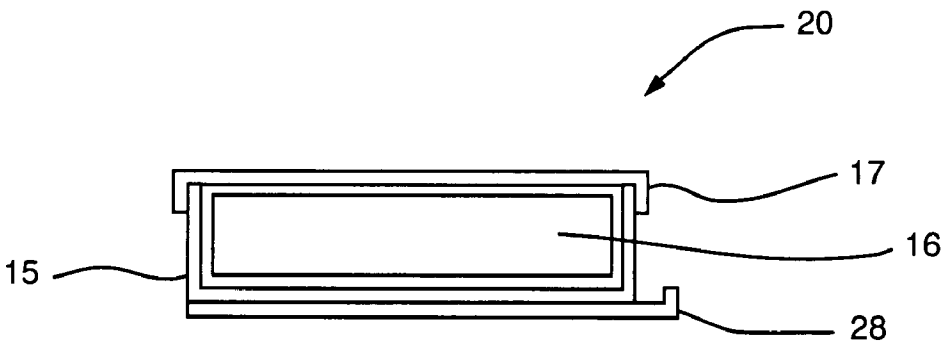
FIG. 2 is a schematic sectional view showing a loaded container embodying the invention.

In accordance with the invention, and with reference to FIG. 1 in the drawing, reference character 10 designates a filling station for particulate materials, including a stack of collapsed containers 11, a source of synthetic resinous liner elements 12, as well as a hopper element 15 of known type which dispenses on demand particulate contents, such as cereal grains, corn or bran flakes, and the like (not shown). Reference character 15 designates an erected container having an open liner element 16 and a lid or cover 17.

Figure 4:
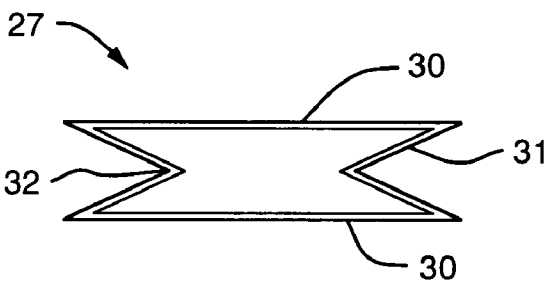
FIG. 4 is a schematic top plan view of a reinforcing element.
Figure 3:
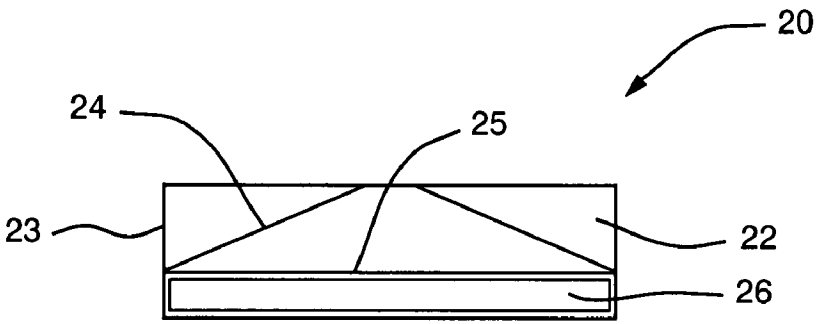
FIG. 3 is a schematic view in elevation of a collapsible container element.

The containers 11 are of known type, and reference is made to U.S. Pat. No. 4,596,355 dated Jun. 24, 1986 and granted to Julius B. Kupersmit, this patent disclosing and describing a collapsible container of the type required, although the presently employed containers are made of lighter weight materials and do not require the details of reinforcement disclosed for the present purposes. The stack 11 comprising individual containers 20, including a collapsible section 21 having side walls one of which is indicated by reference character 22, end walls 23 as well as fold lines 24 which permit folding of the collapsible section 21 above a horizontal fold line 25 which forms a storage section 26 for a reinforcing insert 27 (FIG. 4). The bottom of the container 20 may be provided with a suitable slip sheet 28 of fibrous or synthetic resinous material, as is known in the art.

The reinforcing element 27 includes rigid side walls 30, as well as end walls, 31, each of which is provided with an axially-positioned vertical fold line 22 to enable the same to be folded to planar condition and stored in the recess 26, again as known in the art. When in collapsed condition, the containers are shipped with the lid or cover 17 in position to provide a rectangular enclosure enabling convenient stacking.

Operation of the method will be apparent from a consideration of FIG. 1. Prior to commencement of operation, the stack of collapsed containers 11 is positioned adjacent the hopper element, and a stack or roll of synthetic resinous liner elements 12 may be positioned on an opposite side of the hopper element.

With the commencement of operation, the uppermost container element in the stack is moved therefrom to be erected beneath the hopper element, and a liner element is subsequently positioned in the open mouth of the erected container. The container is then filled to a predetermined level, following which the open mouth of the liner element is closed, or preferably heat sealed to maintain the contents in sanitary condition until and during shipment. The placing of the lid upon the sealed liner element encloses the container, the lid being maintained in closed condition by known clips (not known), taping, or other convenient means. The loading cycle is then repeated. As the supply of collapsed containers or liner elements is exhausted, they may be replaced as required.

By use of the present method, it is possible to eliminate the necessity of prior manual assembly of boxes which are manufactured in planar form, and which must be assembled, as contrasted with merely erected, in advance and wherein it is possible to have only a relatively small number of assembled boxes and lids in the area of the filling station at any one time, thus substantially reducing the amount of manual labor which must be expended in the area of the filling station. By employing lightweight materials in the manufacture of the collapsible containers, the cost of manufacture is significantly reduced, permitting the discarding of the container after a single use, without the necessity of a return shipment of empty containers for refilling.

I wish it to be understood that I do not consider the invention to be limited to the precise details of structure illustrated and described in the specification, for obvious modifications will occur to those skilled in the art to which the invention pertains.

The invention claimed is:

1. A method for containing lightweight particulate materials for bulk shipment comprising the steps of:

a) providing a filling station including a hopper for dispensing said materials;

b) providing a stack of collapsible preassembled containers, each having a cover in generally planar collapsed condition;

c) providing a supply of synthetic resinous bag-like liner elments;

d) serially placing and erecting said collapsed container into an erected condition underneath said hopper;

e) placing an individual liner element within an erected container element which is located underneath the hopper;

f) filling said liner element with said particulate material to desired level while underneath the container; and g) closing said liner element and closing said container element with a separate cover.

2. The method in accordance with claim 1, in which said container elements include integral slip sheets.

3. The method in acccordance with claim 1, in which said liner elements are closed by a heat sealing operation.

* * * * *